US007313480B2

(12) United States Patent
Chen et al.

(10) Patent No.: US 7,313,480 B2
(45) Date of Patent: Dec. 25, 2007

(54) INTEGRATED DRILLING DYNAMICS SYSTEM

(75) Inventors: Chenkang David Chen, Houston, TX (US); Mark Smith, New Orleans, LA (US); Scott LaPierre, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 329 days.

(21) Appl. No.: 10/759,333

(22) Filed: Jan. 16, 2004

(65) Prior Publication Data

US 2004/0245017 A1 Dec. 9, 2004

Related U.S. Application Data

(60) Provisional application No. 60/440,819, filed on Jan. 17, 2003.

(51) Int. Cl.
*G06F 19/00* (2006.01)
*G01V 19/00* (2006.01)

(52) U.S. Cl. ..... 702/9; 702/6

(58) Field of Classification Search ..... 702/1–16; 175/45–50, 40; 73/152.19; 166/250.07; 434/299; 388/809
See application file for complete search history.

(56) References Cited

U.S. PATENT DOCUMENTS

| | | | | |
|---|---|---|---|---|
| 5,201,292 | A | 4/1993 | Grajski et al. | |
| 5,224,201 | A * | 6/1993 | Kruger | 388/809 |
| RE34,435 | E | 11/1993 | Warren et al. | |
| 5,448,227 | A | 9/1995 | Orban et al. | |
| 5,842,149 | A * | 11/1998 | Harrell et al. | 702/9 |
| 5,864,058 | A | 1/1999 | Chen | |
| 6,205,851 | B1 | 3/2001 | Jogi | |
| 6,732,052 | B2 * | 5/2004 | Macdonald et al. | 702/6 |

* cited by examiner

*Primary Examiner*—John Barlow
*Assistant Examiner*—Victor J. Taylor
(74) *Attorney, Agent, or Firm*—Browning Bushman P.C.

(57) ABSTRACT

A method and apparatus for controlling a drilling operation involving the rotation of a bottom-hole assembly carried by a drillstring. In one embodiment, an integrated, closed-loop rigsite analysis system is provided for acquiring and analyzing real-time mud logging and downhole data, and displaying in real-time values of one or more operator-controllable parameters, along with dynamic critical values of at least one controllable operating parameter, thereby enabling an operator to modulate such parameter on a real-time basis to optimize operation. The integrated information is derived by intelligent combination of data into meaningful and useable information that can be displayed in an informative manner.

18 Claims, 3 Drawing Sheets

INTEGRATED DRILLING DYNAMICS SYSTEM

RELATED APPLICATION

This application claims the priority of prior provisional application Ser. No. 60/440,819, filed on Jan. 17, 2003, which application is hereby incorporated by reference herein in its entirety.

FIELD OF THE INVENTION

The present invention relates generally to the field of oil and gas production, and more particularly relates to oil and gas well drilling equipment.

BACKGROUND OF THE INVENTION

Drilling costs are a critical factor in determining the financial returns from an oil and gas investment. This is particularly so in the offshore environment, where operating costs are high, and in wells in which drilling problems are likely to occur. Severe vibrations in particular have been shown to be harmful to downhole equipment used for drilling oil and gas wells. Among them, lateral vibrations, particularly backward whirl, are commonly associated with drillstring fatique failure (wash-outs, twist-offs) excessive bit wear and measuring-while-drilling ("MWD") tool failure. Lateral vibrations are caused by one primary reason—mass imbalance through a variety of sources, including bit-formation interaction, mud motor, and drillstring mass imbalance, among others.

A rotating body is unbalanced when its center of gravity does not coincide with its axis of rotation. Due to such a crookedness or mass imbalance, centrifugal forces are generated while the unbalanced drillstring is rotating. The magnitude of the centrifugal force depends, inter alia, upon the mass of the drillstring, the eccentricity, and the rotational speed. In general, the higher the rotational speed, the greater the centrifugal force. Thus, a common practice is to lower the rotary speed when severe lateral vibration occurs. However, those of ordinary skill in the art will appreciate that vibration may not be reduced if the lower rotational speed results in a resonant condition in the assembly. A resonant condition occurs when the rotational frequency of any one of the excitation mechanisms matches the natural or resonant frequencies (bending, axial, or torsional) of the bottom hole assembly ("BHA"), often referred to as critical rotary speeds or CRPMs. Under a resonant condition, the BHA has a tendency to vibrate laterally with continuously increasing amplitudes, resulting in severe vibration and causing drillstring and MWD failures.

Those of ordinary skill in the art will appreciate that it is important to identify and avoid critical rotary speeds during drilling operation. A number of finite element analysis-based computer programs have been developed to predict critical rotary speeds in drillstrings. However, the accuracy of predictions from such programs is often limited due to uncertainties in the input data and specified boundary conditions. Conventional BHA dynamics software is usually run during well planning or sometimes at the rig, when the BHA is made up. A set of predicted critical CRPMs to be avoided is then provided to the driller.

Common operational difficulties with conventional approaches to avoiding CRPMs are (i) complex BHA modeling and results; (ii) inaccurate modeling and results due to incorrect input data; and (iii) modeling results not being used in conjunction with real-time vibration data to optimize the drilling process. That is to say, in the prior art is has not customarily been the case that dynamics analysis is carried out in an integrated, closed-loop manner, but instead occurs primarily or exclusively during the well-planning phase, such that there is limited opportunity for optimization of well operation.

SUMMARY OF THE INVENTION

In view of the foregoing and other considerations, the present invention is directed to a method and apparatus for providing accurate modeling of BHAs through a combination of real-time modeling and downhole measurement-while-drilling ("MWD") data. As used herein, the descriptor "real-time" shall be interpreted to encompass actions taken essentially immediately. "Real-time data acquisition," for example, means acquiring data reflecting the current state of operational parameters. Likewise, "real-time data processing" means immediate processing of acquired data, as opposed to situations where data is acquired, stored, and processed at a later time. "Real-time data processing" is further to be distinguished from situations in which data is predicted in advance of an actual process and analysis of predictive data is subsequently used in conjunction with the carrying out of the process. As a related concept, the term "dynamic" as used herein shall refer to parameters and other variables whose values are subject to change over time. As a simple example, the rotational speed of a bottom-hole assembly during a drilling operation is a dynamic parameter, inasmuch as the rotational speed is subject to change for any one of a variety of reasons during a drilling operation.

In accordance with one aspect of the invention a system is provided comprising: (1) a real-time BHA dynamics application; (2) an MWD downhole vibration sensor; and (3) an integrated, closed-loop rigsite information system. In one embodiment, the real-time dynamics application is provided for predicting critical rotary speeds (CRPMs). In one embodiment, the dynamics analysis application is a finite element based program for calculating the natural frequencies of the BHA. In an alternative embodiment, the dynamics analysis application may further employ semi-analytical methods for predicting upper boundary conditions.

In accordance with another aspect of the invention, a downhole vibration sensor is provided for generating real-time downhole vibration data. In a preferred embodiment, the sensor is disposed in an existing MWD tool, and comprises three mutually orthogonal accelerometers to measure three axes of acceleration, X, Y, and Z. The X-axis is used to measure both lateral and radial accelerations, the Y-axis is used to measure both lateral and tangential accelerations, and the Z-axis is used to measure axial accelerations. The signal from each axis' sensor is conditioned using three different methods: average, peak, and instantaneous (burst). The average measurement represents the average acceleration over a sampled period. The peak measurement represents the highest acceleration that has occurred over the sampled period, and the instantaneous (burst) measurement records high-frequency data for frequency analysis.

Using three different accelerations and measurements, various modes of downhole dynamics (e.g., bit and BHA whirl, bit bounce and stick-slip, etc. . . . ) can be detected using appropriate algorithms. Indications of destructive vibration mode(s) are then transmitted to the surface. A display is used to indicate the vibration severity, and recommendations are made to correct various modes of downhole vibration that can be identified by the tool.

In accordance with still another embodiment of the invention, an integrated, closed-loop rigsite analysis system is provided for acquiring the mud logging and downhole data, running the analytical software, and displaying data in real-time, thereby enabling an operator to modulate one or more operational parameters of the drilling system on a real-time basis to optimize operation. The integrated information is derived by intelligent combination of data into meaningful and useable information that can be displayed in an informative manner.

BRIEF DESCRIPTION OF THE DRAWINGS

The foregoing and other features and aspects of the subject invention will be best understood with reference to a detailed description of specific embodiments of the invention, which follow, when read in conjunction with the accompanying drawings, wherein.

DETAILED DESCRIPTION OF SPECIFIC EMBODIMENTS OF THE INVENTION

The disclosure that follows, in the interest of clarity, does not describe all features of actual implementations. It will be appreciated that in the development of any such actual implementation, as in any such project, numerous engineering and design decisions must be made to achieve the developers' specific goals and subgoals, which may vary from one implementation to another. Moreover, attention will necessarily be paid to proper engineering and programming practices for the environment in question. It will be appreciated that such a development effort might be complex and time-consuming, but would nevertheless be a routine undertaking for those of ordinary skill in the relevant field.

Figure 1:
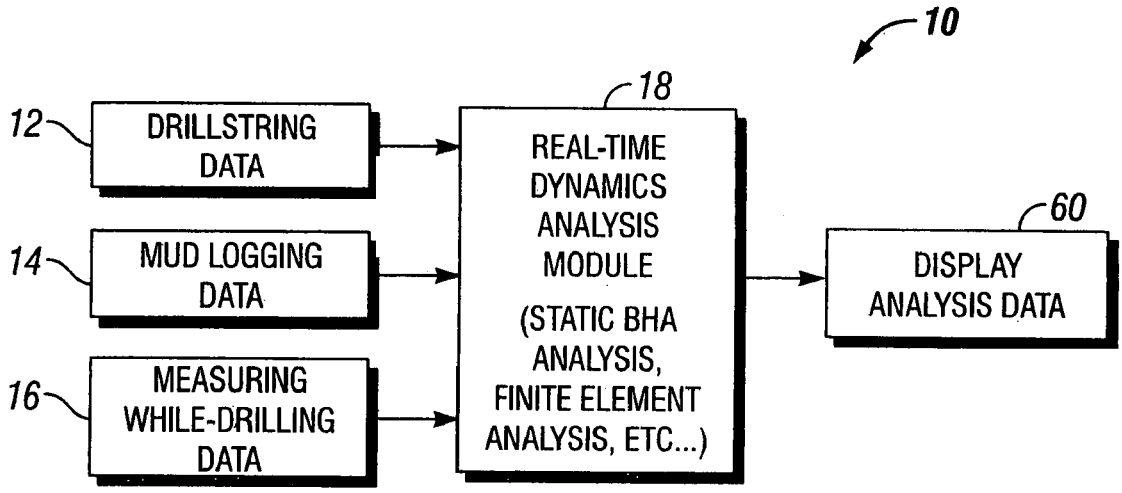
FIG. 1 is a functional block diagram of an integrated, real-time drilling dynamics analysis system in accordance with one embodiment of the invention.

Referring to FIG. 1, there is shown a block diagram depicting the high-level functionality of an integrated drilling dynamics system 10 in accordance with one embodiment of the invention. As shown in FIG. 1, the present invention involves the collection and analysis of various operational data relating to various operational parameters of the well, drillstring, and bottom hole assembly (BHA). Block 12 represents the acquisition of various drillstring data, much of which may be known at the well-planning phase of the overall operation. Block 14 in FIG. 1 represents the acquisition of mud logging data, which those of ordinary skill in the art will recognize as including, without limitation, weight-on-bit data, rotational speed (RPM) information, mud weight data, and so on. Much of the data acquired as represented by block 14 is dynamic, inasmuch as it is subject to ongoing change during the actual drilling operation. Among these parameters, certain may be considered operator-controllable, inasmuch as conventional drilling facilities will provide a means for the drilling operator to adjust them during the operation. Likewise, block 16 in FIG. 1 represents acquisition of measuring-while-drilling (MWD) data, including, for example, inclination, dog-leg severity (DLS), hole size, and so on. As with the data acquisition represented by block 14, that of block 16 represents operational parameters which are subject to change throughout the drilling operation.

Figure 2:
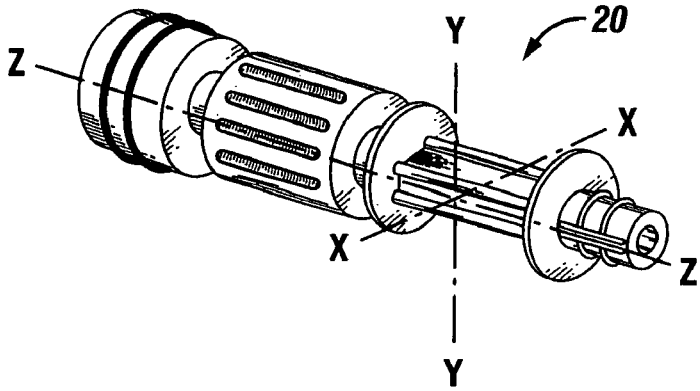
FIG. 2 is a diagram of a drillstring dynamics sensor utilized in conjunction with the integrated drilling dynamics analysis system of FIG. 1.

Regarding the mud logging data of block 14, this real-time downhole data, notably including vibration data, may be supplied by a drillstring sensor such as the commercially-available Sperry-Sun DDS™ (Drillstring Dynamics Sensor). An exemplary DDS 20 is shown in FIG. 2. As would be familiar to those of ordinary skill in the art, the DDS 20 is preferably located in an existing MWD tool such as a Gamma ray sub. In one embodiment, three mutually orthogonal accelerometers are used to measure three axes of accelerations, X, Y, and Z. The X-axis is used to measure both lateral and radial accelerations, the Y-axis is used to measure both lateral and tangential accelerations, and the Z-axis is used to measure axial accelerations.

The signal from each axis accelerometer is preferably conditioned using three different methods: average, peak, and instantaneous (burst). The average measurement represents the average acceleration over a predetermined sample period. The peak measurement represents the highest acceleration which has occurred over a predetermined sample period, and the instantaneous (burst) measurement records high-frequency data for frequency analysis.

Using the three different acceleration measurements for each axis, various modes of downhole dynamics (e.g., bit and BHA whirl, bit bounce, bit stick-slip, and the like) can be detected using appropriate methods which would be familiar to those of ordinary skill in the art. Indications of destructive vibration mode(s) are then transmitted to the surface using known methods, and indicia of these measurements can be displayed to reflect vibration severity at any given time. On the other hand, it is contemplated that sensors other than the Sperry-Sun DDS™ sensor, including sensors having more or less than three axes of sensitivity, may be employed in the practice of the present invention. Those of ordinary skill in the art having the benefit of the present disclosure will be familiar with various alternatives suitable for detecting undesirable dynamic operation of a drillstring and BHA.

With continued reference to FIG. 1, all of the data acquired by blocks 12, 14, and 16 is provided to a real-time dynamics analysis module 18. In the preferred embodiment, dynamics analysis module 18 performs several functions, including static BHA analysis to calculate upper boundary conditions, finite element analysis to calculate natural (resonant) frequencies and mode shapes, and other methods for calculating critical rotary speeds (CRPMs).

In the preferred embodiment, and in accordance with an important aspect of the invention, the dynamics analysis software module runs in real-time, i.e., during the actual drilling operation and processes all of the static, dynamic, and real-time data supplied by functional blocks 12, 14, and 16. Conventional mud logging data from block 14 include BHA configuration data, weight-on-bit (WOB) data, rotational speed (RPM), mud weight, and various other such operational parameters of the drilling operation. Such data can be obtained from an integrated surface system, or via transfer from third-party mud logging or other digital rig monitoring systems commonly employed by drilling contractors. As noted above, MWD data from block 16 includes inclination, DLS, hole size, and so on.

Figure 3:
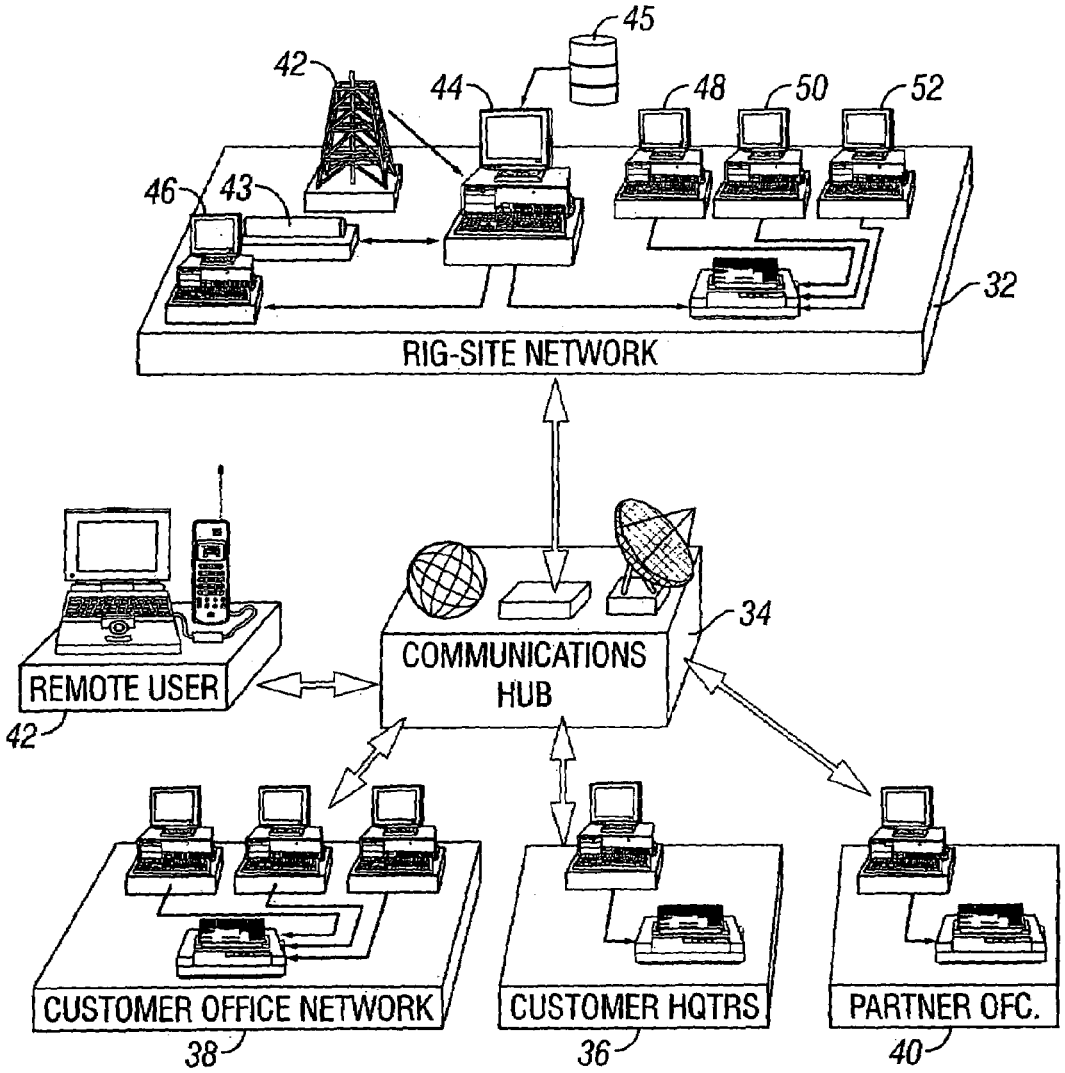
FIG. 3 is a diagram of a rigsite information system incorporating the drilling dynamics analysis system of FIG. 1.

In accordance with one embodiment of the invention, the system is implemented on an integrated rigsite information system 30 such as is schematically depicted in FIG. 3. As shown in FIG. 3, the rigsite network 32 involves interconnection of various components, including a drilling rig 42 and its associated downhole sensors and tools 43, a real-time analysis server and database 44, preferably with an associated historical data store 45. and a plurality of workstations, including, for example, a workstation 48 for a company man, a workstation 50 for a geologist, a workstation 52 for the driller, and a workstation 46 for supporting third-party systems. In accordance with customary implementations, one or more of the various workstations associated with rigsite network would be capable of allowing a drilling operator to control various parameters of a drilling operation. As a simplistic, but certainly not exclusive example, a drilling operator will preferably be capable of modulating or adjusting an operational parameter such as BHA rotational speed during a drilling operation on a real-time, dynamic basis.

As would be apparent to those of ordinary skill in the art, the modalities of interconnection between the various components of information system 30 may vary from case to case, including, for example, satellite and Internet connectivity, radio-frequency transmissions, and so on, as is customary in the industry.

In one embodiment, analysis server 44 comprises a processing system of sufficient computational capability to implement the dynamics analysis functionality described with reference to block 18 in FIG. 1. In accordance with an important aspect of the invention, analysis server 44, and, perhaps, various other workstations as shown in FIG. 3, has a graphical display associated therewith for presenting to the drilling operator a visual display of the results of the real-time dynamics analysis performed by real-time dynamics analysis module 18. Such a function is represented by block 60 in FIG. 1. This aspect of the invention is critical, as it represents the integration of the dynamics analysis function 18 with the data acquisition functions (blocks 12, 14, and 16) in real-time, thereby enabling the drilling operator to respond to analytical results in real-time to achieve optimal drilling performance.

Figure 4:
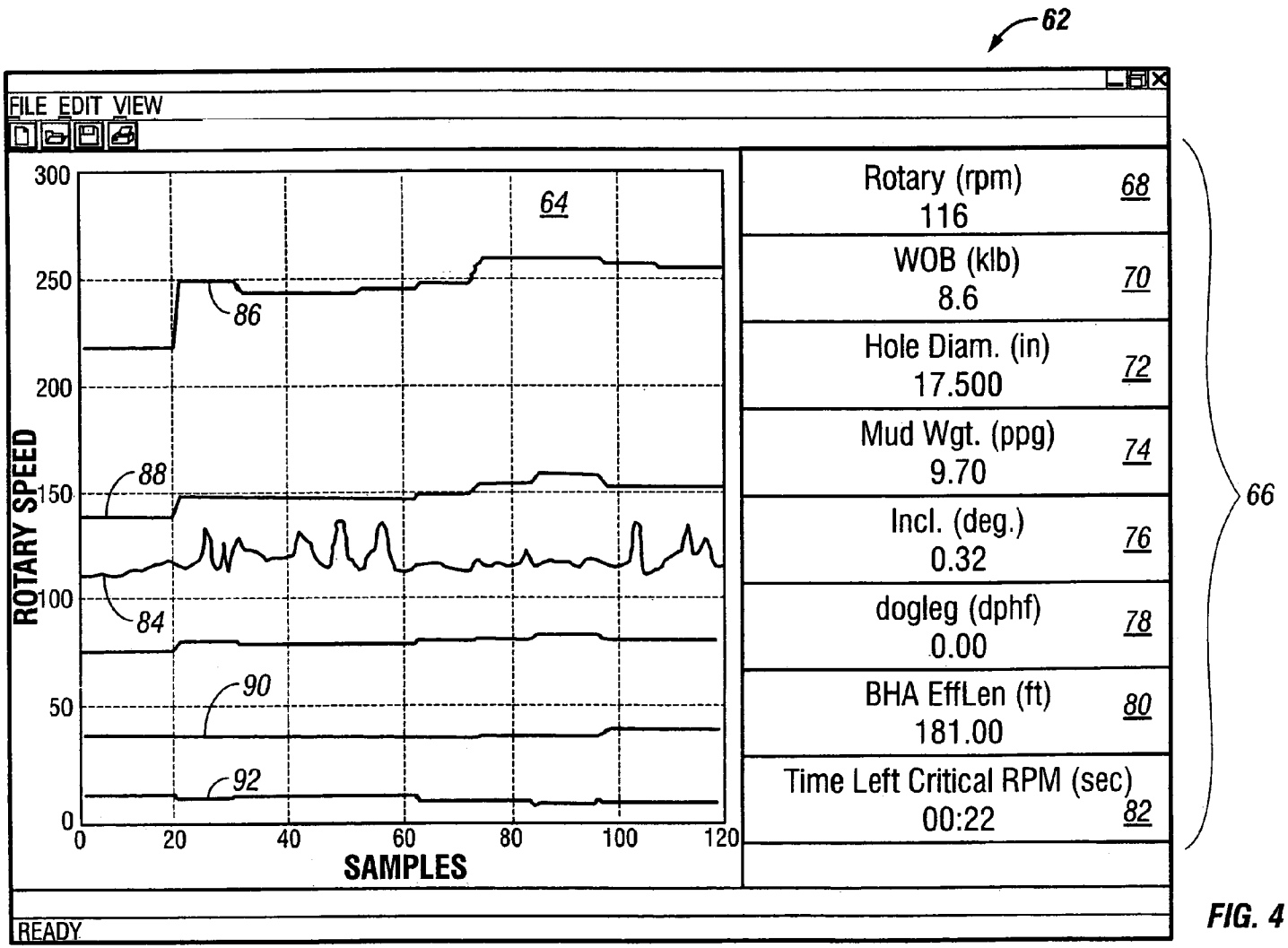
FIG. 4 is a representation of a drillstring dynamics data display screen generated in real time during a drilling operation utilizing the system of the invention.

An exemplary display screen 62 of the analysis data as represented by block 60 in FIG. 1 is shown in FIG. 4. As shown, display 62 presents a graph 64 of an operational parameter (speed) over time corresponding to the current operation of the drill bit. Further, display 64 in accordance with the presently disclosed embodiment presents a plurality of real-time operational parameters derived directly or through computation and analysis from data from acquisition modules 12, 14, and 16, including, in the exemplary embodiment, such parameters as current RPM 68, weight-on-bit 70, hole diameter 72, mud weight 74, inclination 76, dogleg angle 78, BHA effective length 80, and an indication of the time left until the next update of the real-time analysis. Of course, it would be the objective of the drilling operator to monitor and adjust controllable parameters to maximize the latter datum (time left to CRPM 82) at any given time.

As shown in FIG. 4, in the rotational speed graph 64 a plurality of different traces are presented. Most important is trace 84 showing in real-time the current rotational speed of the bit. In addition to current RPM trace 84 are a plurality of CRPM traces 86, 88, 90, and 92. As can be seen in FIG. 4, the CRPM traces are not static rotational rates as might be derived from well-planning analysis as in the prior art, but rather are dynamic, varying traces reflecting values which change based upon real-time analysis of the actual current drilling operation parameters discussed above.

As a consequence of the display 62 of FIG. 4, a drilling operator is capable of observing readily the relation between all of the various operating parameters as they exist in real time, allowing the operator to make operational adjustments which tend to lead to optimal drilling operation. Although not shown in FIG. 4, display 62 may in a particular embodiment be displayed with or include other graphical displays and traces, such as traces of the output of the DDS sensors showing average, peak, and instantaneous acceleration of the BHA. This advantageously provides the operator further insight into the overall real-time operational state of the drilling process and a corresponding ability to make appropriate adjustments for optimizing the drilling operation.

Certain scenarios are envisioned which illustrate the efficacy of the present invention as contrasted with prior art dynamics analysis systems not integrating MWD and other operational data with real-time feedback from a drilling operation. In one scenario, a straight mud motor assembly with a 14.5" by 17.5" bi-center bit is used to drill a vertical section, without the benefit of the closed-loop, integrated methodology of the present invention. In such a situation, the DDS sensor vibration data collected might not show a high magnitude of vibrations. The average lateral vibrations may indicate a relatively low to medium severity, and the axial vibrations may be very low. Despite such benign indications, the vibration frequencies may match motor rotor speed, suggesting that motor vibration could be responsible for a parting of the mud motor; however, the majority of vibration energy could be absorbed by the motor itself, thus eluding detection by a vibration sensor at the MWD tool.

On the other hand, an alternative scenario is envisioned wherein a similar drilling operation is undertaken while the integrated, closed-loop system of the present invention is implemented. In such a scenario, a correlation between CPRMs and increased lateral vibrations can be observed, such that the drilling operator can safely avoid critical conditions of high severity vibration. With a display such as depicted in FIG. 4, the operator is able to avoid encroachment on CRPMs that are likely to lead to component failure, while at the same time not being required to simply immediately stop drilling. Instead, an operator may elect based upon the advantages of the present invention to increase rotational speed to avoid encroachment on a CRPM to remove resonant excitation and thereby stop vibration and avoiding cessation of the drilling operation.

The foregoing disclosure demonstrates numerous advantageous features of the present invention. Firstly, in recognition that resonance has been shown to be an important cause of BHA and bit whirl, the present invention takes into account that there is a good correlation between bit speed predictions and the onset of BHA and bit whirl, and that real-time reactions to indicia of such effects can significantly reduce the likelihood of adverse operational effects. Secondly, frequency analyses of high-frequency burst analyses have shown to be effective in identifying the vibration mechanisms and supporting the accuracy of the modeling, whereas in prior art systems, there has been no effective mechanism for drawing upon this recognition. As a fundamental feature of the invention, there has been no prior art recognition of the advantages of real-time modeling of a drilling operation as compared with well-planning (pre-run) modeling. As a specific example, BHA instability due to enlarged holes, while known to be an important factor in BHA and bit whirl, the prior art has not proven capable of avoiding critical RPMs in the manner contemplated by the present invention.

In sum, combining real-time modeling and real-time downhole vibration data in an integrated system in accordance with the present invention is effective in identifying the vibration mechanisms and thereby avoiding harmful vibrations to an extend heretofor not achieved.

From the foregoing description of one or more particular implementations of the invention, it should be apparent that a system and method for distribution of integrated, real-time drilling dynamics analysis and control has been disclosed which offers significant advantages over present methodologies. Although a broad range of implementation details have been discussed herein, these are not to be taken as limitations as to the range and scope of the present invention as defined by the appended claims. A broad range of implementation-specific variations and alterations from the disclosed embodiments, whether or not specifically mentioned herein, may be practiced without departing from the spirit and scope of the invention as defined in the appended claims.

What is claimed is:

1. A method of controlling a drilling operation involving rotation of a bottom hole drilling assembly carried by a drillstring, comprising:

(a) obtaining real-time sensor data regarding at least one dynamic operational parameter of said bottom hole assembly;

(b) performing real-time analysis of said sensor data to calculate at least one dynamic critical value of an operator-adjustable operational parameter of said bottom hole assembly;

(c) presenting to an operator a display of the real-time value of said operator-adjustable operational parameter over time along with the real-time value of said at least one dynamic critical value of said operator-adjustable operational parameter.

2. A method in accordance with claim 1, further comprising:

(d) providing means for an operator of said drilling operation to adjust the value of said operator-adjustable operational parameter to avoid said critical value.

3. A method in accordance with claim 2, wherein said operator-adjustable operational parameter comprises rotational speed of said bottom hole assembly.

4. A method in accordance with claim 1, wherein said real-time sensor data regarding at least one operational parameter includes without limitation vibrational data.

5. A method in accordance with claim 4, wherein said vibrational data includes lateral vibration data.

6. A method in accordance with claim 3, wherein said at least one critical value comprises a resonant frequency of said bottom hole assembly and drill string.

7. An apparatus for carrying out a drilling operation involving rotation of a bottom hole drilling assembly carried by a drillstring, comprising:

a sensor for obtaining real-time sensor data regarding at least one dynamic operational parameter of said bottom hole assembly;

a dynamics analysis application for peforming real-time analysis of said sensor data and calculating at least one dynamic critical value of an operator-adjustable operational parameter of said bottom hole assembly;

a display for presenting to an operator the real-time value of said operator-adjustable operational parameter over time along with the real-time value of said at least one dynamic critical value of said operator-adjustable operational parameter.

8. An apparatus in accordance with claim 7, further comprising:

means for an operator of said drilling operation to adjust the value of said operator-adjustable operational parameter to avoid said critical value.

9. An apparatus in accordance with claim 8, wherein said operator-adjustable operational parameter comprises rotational speed of said bottom hole assembly.

10. An apparatus in accordance with claim 7, wherein said real-time sensor comprises a vibrational sensor.

11. An apparatus in accordance with claim 10, wherein said vibrational sensor detects vibration in three orthogonal axes.

12. An apparatus in accordance with claim 9, wherein said at least one critical value comprises a resonant frequency of said bottom hole assembly and drill string.

13. A system for controlling a drilling operation involving rotation of a bottom hole drilling assembly carried by a drillstring, comprising:

a sensor for obtaining real-time sensor data regarding at least one dynamic operational parameter of said bottom hole assembly;

a dynamics analysis application for peforming real-time analysis of said sensor data and calculating at least one dynamic critical value of an operator-adjustable operational parameter of said bottom hole assembly;

a display for presenting to an operator the real-time value of said operator-adjustable operational parameter over time along with the real-time value of said at least one dynamic critical value of said operator-adjustable operational parameter.

14. A system in accordance with claim 13, further comprising:

means for an operator of said drilling operation to adjust the value of said operator-adjustable operational parameter to avoid said critical value.

15. A system in accordance with claim 14, wherein said operator-adjustable operational parameter comprises rotational speed of said bottom hole assembly.

16. A system in accordance with claim 13, wherein said real-time sensor comprises a vibrational sensor.

17. A system in accordance with claim 16, wherein said vibrational sensor detects vibration in three orthogonal axes.

18. A system in accordance with claim 15, wherein said at least one critical value comprises a resonant frequency of said bottom hole assembly and drill string.

* * * * *